US009969585B2

(12) United States Patent
Oki et al.

(10) Patent No.: US 9,969,585 B2
(45) Date of Patent: May 15, 2018

(54) RECORDING APPARATUS

(71) Applicant: SEIKO EPSON CORPORATION, Tokyo (JP)

(72) Inventors: Narihiro Oki, Nagano (JP); Shinji Kanemaru, Nagano (JP); Shintaro Miyamoto, Nagano (JP); Keisuke Sasaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 643 days.

(21) Appl. No.: 14/678,522

(22) Filed: Apr. 3, 2015

(65) Prior Publication Data

US 2015/0290955 A1 Oct. 15, 2015

(30) Foreign Application Priority Data

Apr. 9, 2014 (JP) ..... 2014-079865

(51) Int. Cl.
*B41J 15/04* (2006.01)
*B65H 18/02* (2006.01)
(Continued)

(52) U.S. Cl.
CPC ..... *B65H 18/10* (2013.01); *B41J 11/0095* (2013.01); *B41J 11/485* (2013.01); *B41J 15/042* (2013.01); *B65H 1/04* (2013.01); *B65H 16/06* (2013.01); *B65H 2402/41* (2013.01); *B65H 2404/1112* (2013.01); *B65H 2405/1117* (2013.01); *B65H 2405/324* (2013.01); *B65H 2553/414* (2013.01); *B65H 2801/12* (2013.01)

(58) Field of Classification Search
CPC ..... B65H 7/14; B65H 18/10; B65H 16/06; B65H 1/04; B65H 2801/12; B65H 2404/1112; B65H 2553/414; B65H 2405/1117; B65H 2405/324; B65H 2402/41; B41J 11/50; B41J 15/042; B41J 11/485; B41J 11/0095
See application file for complete search history.

(56) References Cited

U.S. PATENT DOCUMENTS 5,063,395 A * 11/1991 Nuita ..... B41J 11/24 347/220
9,751,338 B2 * 9/2017 Sekino ..... B41J 11/0045
(Continued)

FOREIGN PATENT DOCUMENTS

JP 01108077 A * 4/1989
JP 2000-177190 A 6/2000
(Continued)

*Primary Examiner* — William A. Rivera

(57) ABSTRACT

A recording apparatus includes a hopper which is provided with a mounting surface on which a medium is set, and which is provided to be capable of swinging between a first posture in which the mounting surface of the medium is in a fallen state, and a second posture in which the mounting surface is in an uplifted state, a first pathway that delivers rolled paper, as the medium, to the hopper from an upstream side thereof, a second pathway that delivers cut form paper, as the medium, to the hopper from an upstream side thereof, and a first sensor that detects the medium in the first pathway, wherein the hopper swings from the first posture in a direction that assumes the second posture on the basis of detection of the medium by the first sensor.

6 Claims, 6 Drawing Sheets

(51) Int. Cl.

| | |
|---|---|
| ***B65H 18/10*** | (2006.01) |
| ***B41J 11/00*** | (2006.01) |
| ***B41J 11/48*** | (2006.01) |
| ***B65H 1/04*** | (2006.01) |
| ***B65H 16/06*** | (2006.01) |

(56) References Cited

U.S. PATENT DOCUMENTS

| | | | | |
|---|---|---|---|---|
| 2009/0033733 | A1* | 2/2009 | Higashimoto | B41J 11/485<br>347/104 |
| 2009/0245913 | A1* | 10/2009 | Yamamoto | B26D 1/305<br>400/621 |
| 2013/0258023 | A1* | 10/2013 | Sekino | B41J 11/50<br>347/104 |

FOREIGN PATENT DOCUMENTS

| | | | | |
|---|---|---|---|---|
| JP | 2004307105 | A | * | 11/2004 |
| JP | 2013-112473 | A | | 6/2013 |

* cited by examiner

RECORDING APPARATUS

BACKGROUND

1. Technical Field

The present invention relates to a recording apparatus.

2. Related Art

In recent years, in recording apparatuses such as ink jet recording apparatuses, in addition to recording apparatuses that are used indoors in a non-portable manner, compact recording apparatuses that can be carried outdoors have becomes popular.

Normally, in recording apparatuses, recording is performed by setting a plurality of sheets of paper, as a medium, in a recording apparatus, and feeding the sheets of paper into the recording apparatus one sheet at a time. Meanwhile, there are recording apparatuses that, in addition to recording on cut form paper, which are sheets of paper that are fed one sheet at a time, can perform recording on so-called rolled paper, in which a longitudinal sheet of paper is wound around a roll core in a rolled form. Further, there are also recording apparatuses in the compact recording apparatuses that are capable of using rolled paper.

In a case in which recording is performed on media of a plurality of types of shape such as cut form paper and rolled paper, if a transport pathway is provided for each shape of media, an increase in the size of the apparatus is caused. Therefore, JP-A-2013-112473 discloses a recording apparatus which is provided with two paper sheet transport pathways of a manual supply pathway, and a rolled medium pathway, and in which the rolled medium pathway is configured so as to use the manual supply pathway.

In JP-A-2013-112473, the manual supply pathway has a configuration that delivers sheets of paper, as a medium, to the manual supply pathway through insertion into a tray one sheet at a time, but for example, there are cases in which a plurality of cut form papers are set in an overlapping manner, and a medium supply pathway is used as a transport pathway of the rolled paper, and recording is performed by feeding the cut form paper into the recording apparatus one sheet at a time.

Normally, a plurality of sheets of cut form paper are set on a mounting surface of a hopper that is configured to be capable of swinging between a raised state and a fallen state with respect to a feeding roller. Further, the recording apparatus is configured so that the hopper rises and abuts against the topmost sheet of cut form paper, and the topmost sheet of cut form paper is fed one sheet at a time as a result of the feeding roller rotating.

In addition, in a case in which cut form paper is not mounted on the hopper, the hopper falls to a position at which it is possible to set a predetermined number of sheets of cut form paper.

In a case in which the cut form paper is set on the hopper, whether or not a leading end of the cut form paper is inserted to a correct position is determined by a user abutting an end section of the cut form paper against the interior of the hopper, which is in a fallen state.

In this instance, in a case in which a transport pathway of cut form paper with a configuration that uses this kind of hopper, is used as a transport pathway of the rolled paper, as described above, the rolled paper is set against the hopper, which is in a state of having fallen to a position at which it is possible to set a predetermined number of sheets of cut form paper.

At this time, since there is a space between the hopper, which is in a fallen state, and the feeding roller, there are cases in which the rolled paper becomes rolled up in the space in accordance with a tendency of the roll. If this kind of state occurs, it is difficult for a user to perceive a feeling of an end section of the rolled paper abutting against the hopper (hereinafter, there are cases in which this feeling is referred to as a setting feeling). Furthermore, if it is difficult to perceive the setting feeling of the rolled paper, there is a concern that a user will push more of the rolled paper than is necessary into the recording apparatus.

SUMMARY

An advantage of some aspects of the invention is to provide a recording apparatus in which it is possible to improve the reliability of a setting feeling of rolled paper by a user, and in which it is possible to reliably set the rolled paper when the rolled paper is set in a recording apparatus that can perform recording on both cut form paper and rolled paper.

According to a first aspect of the invention, there is provided a recording apparatus including a hopper which is provided with a mounting surface on which a medium is set, and which is provided to be capable of swinging between a first posture in which a mounting surface of the medium is in a fallen state, and a second posture in which the mounting surface is in an uplifted state, a first pathway that delivers rolled paper, as the medium, to the hopper from an upstream side thereof, a second pathway that delivers cut form paper, as the medium, to the hopper from an upstream side thereof, and a first sensor that detects the medium in the first pathway in which the hopper swings from the first posture in a direction that assumes the second posture on the basis of detection of the medium by the first sensor.

In the disclosure, the "first pathway" is a medium transport pathway for rolled paper that delivers rolled paper, and the "second pathway" represents a medium transport pathway for cut form paper that delivers cut form paper.

According to the aspect of the invention, since the hopper swings from the first posture in a direction that assumes the second posture on the basis of the detection of the medium by the first sensor, which is provided in the first pathway, it is possible to reduce a gap between the hopper and a member that faces the hopper inside the recording apparatus when the rolled paper is set on the hopper. For example, it is possible to include a feeding roller as a member that faces the hopper.

As a result of this configuration, a leading end of the rolled paper is inserted into a more narrow space, and therefore, a concern that the rolled paper will become rolled up as a result of a winding tendency, is reduced, and it is easier to perceive a feeling of a leading end of the rolled paper abutting against the interior of the hopper, that is, a setting feeling of the rolled paper on the hopper.

In view of this, the reliability of the setting feeling of the rolled paper by a user is increased, and therefore, a concern that a user will push more of the rolled paper than is necessary into the recording apparatus, is reduced, and it is possible to reliably set the rolled paper.

According to a second aspect of the invention, there is provided a recording apparatus including a hopper which is provided with a mounting surface on which a medium is set, and which is provided to be capable of swinging between a first posture in which the mounting surface of the medium is in a fallen state, and a second posture in which the mounting surface is in an uplifted state, a first pathway that delivers rolled paper, as the medium, to the hopper from an upstream side thereof, a second pathway that delivers cut form paper, as the medium, to the hopper from an upstream side thereof, a first sensor that detects the medium in the first pathway, and a second sensor that detects that the medium is mounted on the mounting surface of the hopper, in which the hopper swings from the first posture in a direction that assumes the second posture on the basis of detection of the medium by the first sensor and the second sensor.

According to the aspect of the invention, the same effects as those of the first aspect are exhibited by the hopper swinging from the first posture in a direction that assumes the second posture on the basis of detection of the medium by the first sensor and the second sensor.

In addition, it is possible to set a timing with which the hopper swings from the first posture in a direction that assumes the second posture, to when the second sensor detects the medium after the detection of the medium (rolled paper) by the first sensor. Since there are cases in which the rolled paper curls as a result of a winding tendency, there are cases in which insertion into a narrow space is difficult.

When the rolled paper is initially inserted onto the hopper, since the hopper is in the fallen first posture, the insertion of the rolled paper is made easier by swinging the hopper in a manner in which the hopper is lifted up to a side of the second posture when the second sensor detects the medium. Further, when the rolled paper abuts against the interior of the hopper, it is possible to reduce a gap between the hopper and a member that faces the hopper by lifting the hopper up to the side of the second posture after the rolled paper has passed through a predetermined position of the mounting surface of the hopper, and therefore, it is possible to obtain the same effects as those of the first aspect.

In addition, the following effects are exhibited as a result of the recording apparatus being provided with the second sensor that detects the medium that is mounted on the hopper in addition to the first sensor that detects the medium in the first pathway.

For example, there are cases in which a user begins to use rolled paper in a case in which cut form paper is still placed on the hopper. In this instance, in a case in which the second sensor has already detected the medium when rolled paper is detected by the first sensor, it is possible to determine that it is a state in which cut form paper is placed on the hopper. Additionally, it is possible to set a configuration in which a user is notified that there is cut form paper on the hopper using an alarm sound, a user interface (hereinafter, referred to as a UI) or the like.

In the recording apparatus of a third aspect of the invention, according to either the first aspect or the second aspect, a feeding roller that feeds the medium may be further provided, the hopper may be configured so as to come into contact with the feeding roller in the second posture, and the second posture may be assumed when the hopper swings on the basis of the detection of the medium by the sensors.

According to the aspect of the invention, since rolled paper abuts against an opening that is formed by the feeding roller and the hopper coming into contact as a result of the second posture, in which the hopper comes into contact with the feeding roller, being assumed when the hopper swings on the basis of the detection of the medium by the sensors, the perception of the setting feeling of the rolled paper is made easier.

In view of this, the reliability of the setting feeling of the rolled paper by a user is improved.

In the recording apparatus of a fourth aspect of the invention, according to any one of the first aspect to the third aspect, the first pathway and the second pathway may converge further upstream in a medium transport direction than the hopper.

In the disclosure, a direction in the recording apparatus in which a target recording medium is transported is referred to as "downstream", and a direction that is opposite to this is referred to as "upstream".

According to the aspect of the invention, since the first pathway and the second pathway converge further upstream in the medium transport direction than the hopper, it is possible to reliably detect fed rolled paper before the rolled paper is delivered to the hopper.

In addition, in a case in which the recording apparatus is provided with the second sensor that detects that the medium is mounted on the mounting surface of the hopper in addition to the first sensor, it is possible to reliably detect whether rolled paper is delivered to the hopper or whether cut form paper is delivered to the hopper as a result of the second sensor being used for both the cut form paper and the rolled paper, and detecting the rolled paper using the first sensor before the rolled paper is delivered to the hopper.

In the recording apparatus of a fifth aspect of the invention, according to any one of the first aspect to the fourth aspect, a first opening and closing section, which opens and closes an upper surface section of a main body of the recording apparatus, supports the cut form paper that is set on the hopper in an open state, and forms at least a portion of the second pathway may be further provided, and the first pathway may be configured so as to pass between a downstream side end section of the first opening and closing section and the main body from a back surface side of a support surface of the first opening and closing section, and converge with the second pathway on a side of the support surface.

According to the aspect of the invention, it is possible to set a configuration that can reliably detect rolled paper only using the first sensor by providing the first sensor in the first pathway that is provided in the abovementioned manner. As a result of this configuration, there is very little concern that cut form paper will be detected by the first sensor, and therefore, it is possible to reduce a concern that the hopper will be raised mistakenly when cut form paper is set.

In the recording apparatus of a sixth aspect of the invention, according to any one of the first aspect to the fifth aspect, the first sensor may be an optical sensor that is provided with an optical receiving and emitting unit that irradiates the medium with light, and receives reflected light from the medium, and an optical axis of the optical receiving and emitting unit may be inclined toward a downstream side in the medium transport direction with respect to a vertical direction.

Normally, a medium such as rolled paper is transported toward a recording unit, which is provided inside a recording apparatus, by being inserted from a medium supply opening, which is provided on an end section side of the recording apparatus.

According to the aspect of the invention, since an optical axis of the optical receiving and emitting unit of an optical sensor, as the first sensor, is inclined toward a downstream side in the medium transport direction, it is possible to dispose the optical axis of the optical receiving and emitting unit of the optical sensor toward an inner side of the recording apparatus. As a result of this configuration, it is possible to make it difficult for the recording apparatus to be influenced by light from outside the recording apparatus.

In the recording apparatus of a seventh aspect of the invention, according to the sixth aspect, a protective member that covers an upper region of the optical receiving and emitting unit of the first sensor in a position that is separated from the optical receiving and emitting unit of the first sensor may be further provided.

According to the aspect of the invention, it is possible to reduce a concern that light from outside the recording apparatus will enter the optical receiving and emitting unit of the first sensor using the protective member. In addition, since the protective member is provided in a position that is separated from the optical receiving and emitting unit of the first sensor, and therefore, it is possible to configure so that the rolled paper passes between the protective member and the optical receiving and emitting unit of the first sensor, the suppression of curls, which result from a winding tendency of the rolled paper, is made possible by the protective member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to an embodiment of the invention will be described with reference to the appended drawings. Additionally, the invention is not limited by the embodiment.

Embodiment 1

Firstly, a summary of a recording apparatus 1 according to an embodiment of the invention will be described. It is possible to include an ink jet type recording apparatus as an example of the recording apparatus 1 of the present embodiment.

Figure 1:
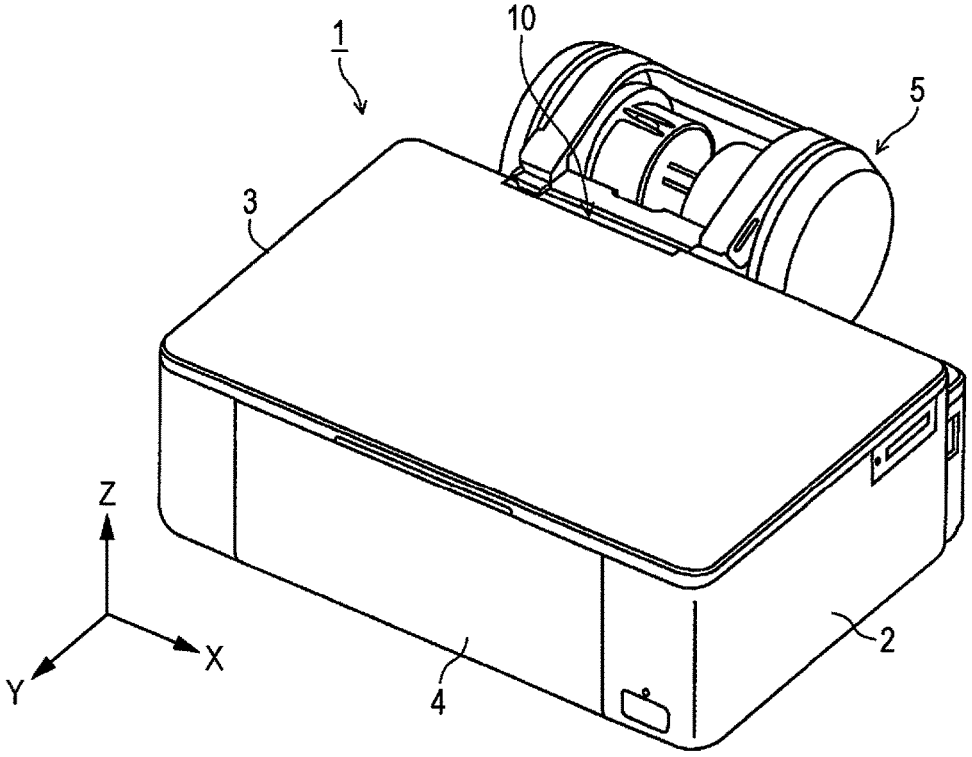
FIG. 1 is a perspective view that represents a recording apparatus according to an embodiment of the invention.
Figure 2:
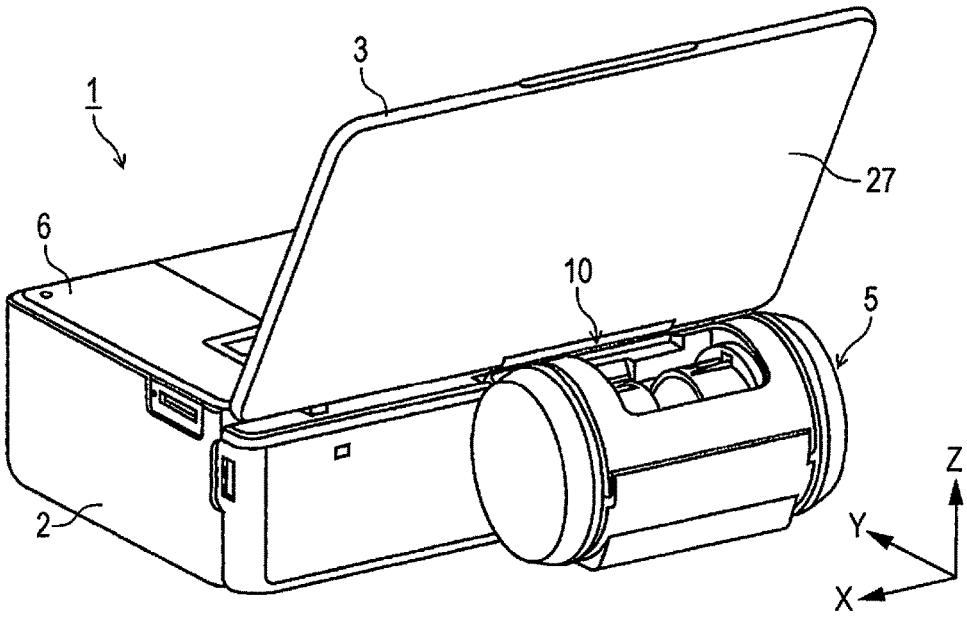
FIG. 2 is a perspective view in which the recording apparatus of FIG. 1 is viewed from behind in a state in which an upper surface cover is open.
Figure 3:
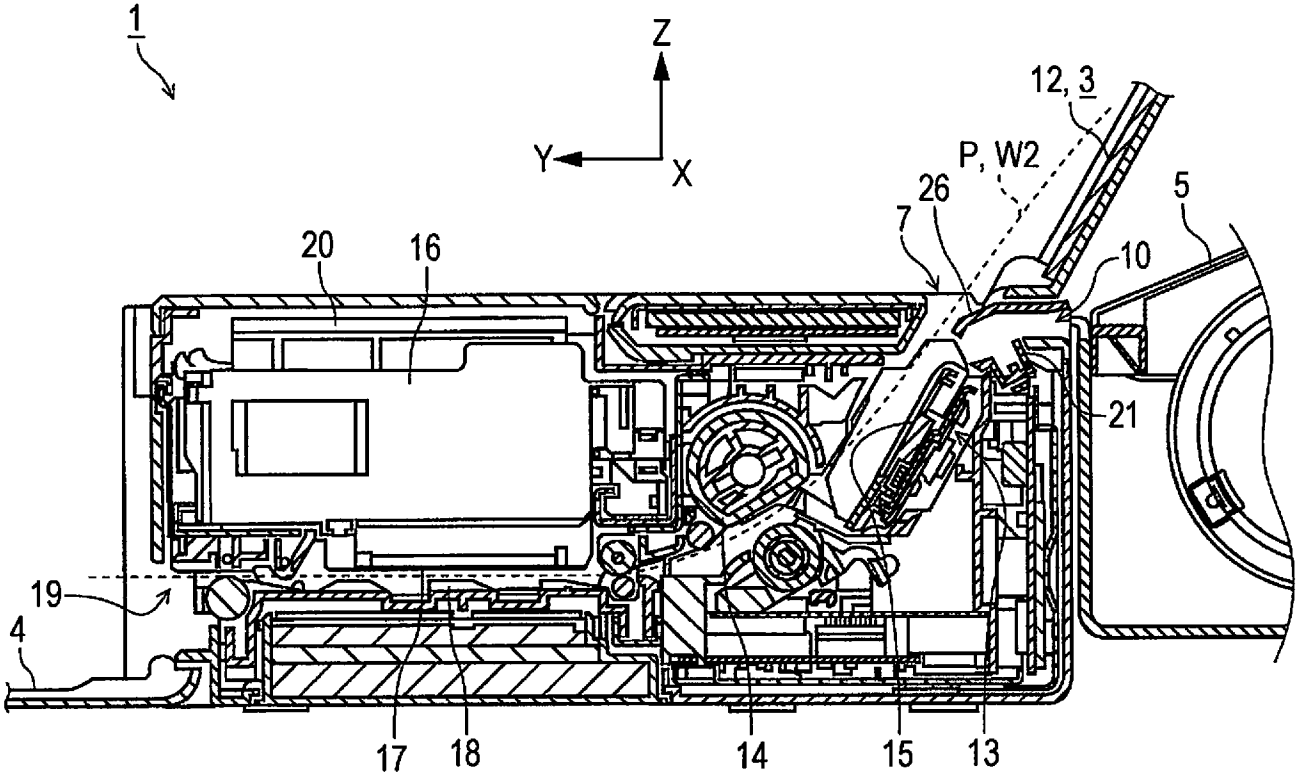
FIG. 3 is cross-sectional view of the recording apparatus that is shown in FIG. 1, and is a view that shows a state in which a first state, in which the hopper is fallen, is assumed.
Figure 4:
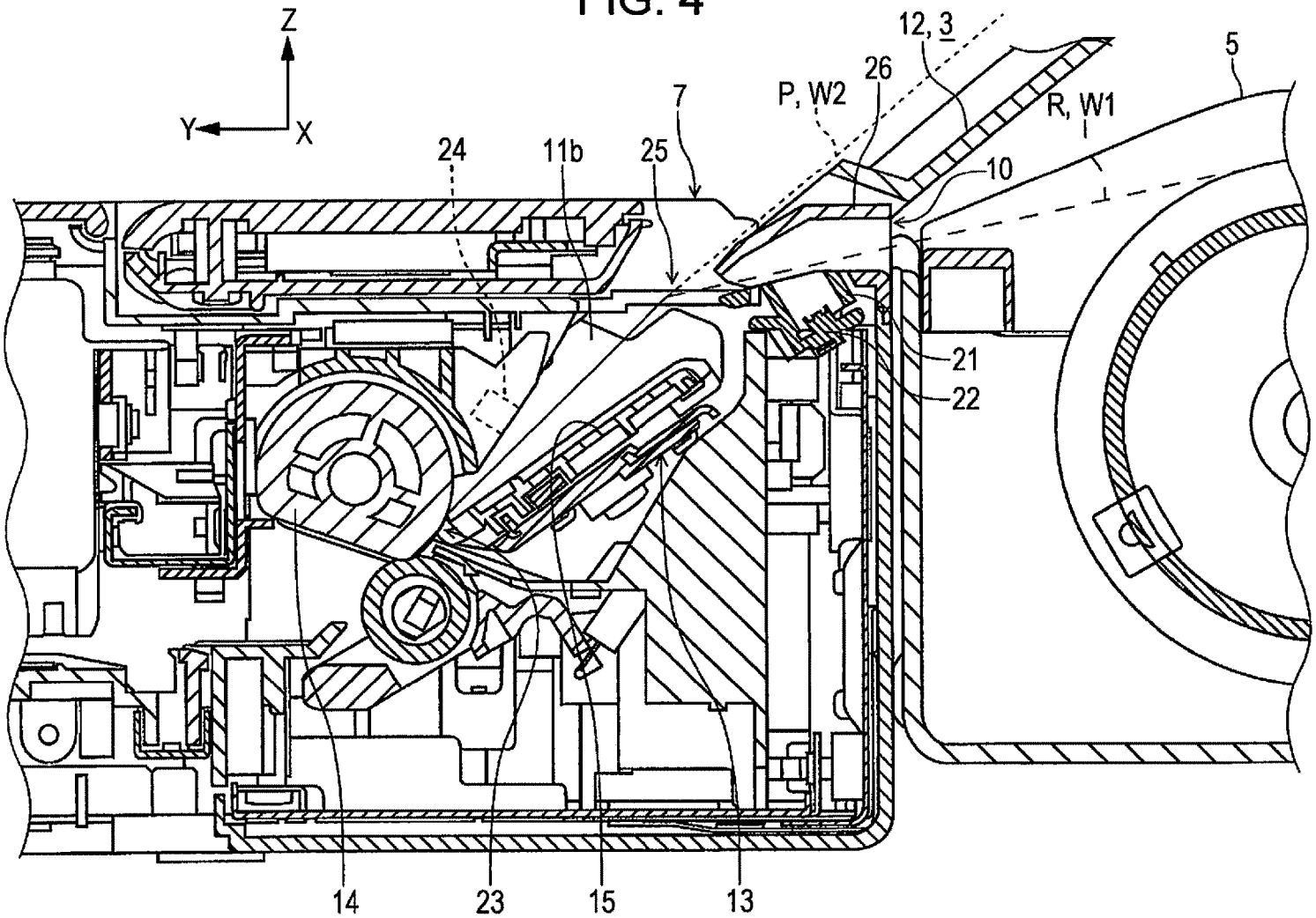
FIG. 4 is an expanded cross-sectional view of the main sections of the recording apparatus that is shown in FIG. 1, and is a view that shows a state in which a second state, in which the hopper is raised, is assumed.
Figure 5:
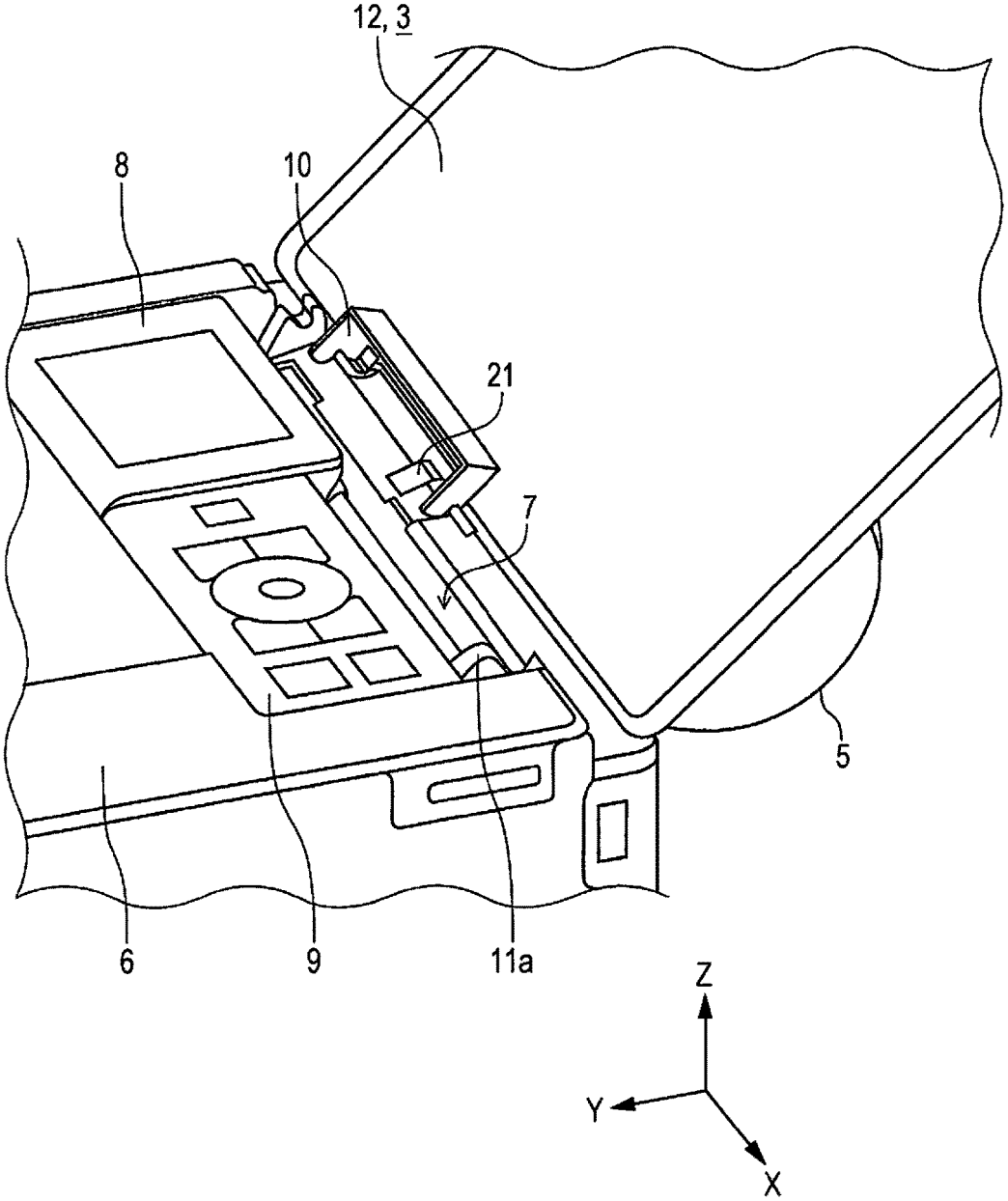
FIG. 5 is a perspective view that represents the main sections of the recording apparatus of FIG. 1 in a state in which the upper surface cover is open.
Figure 6A:
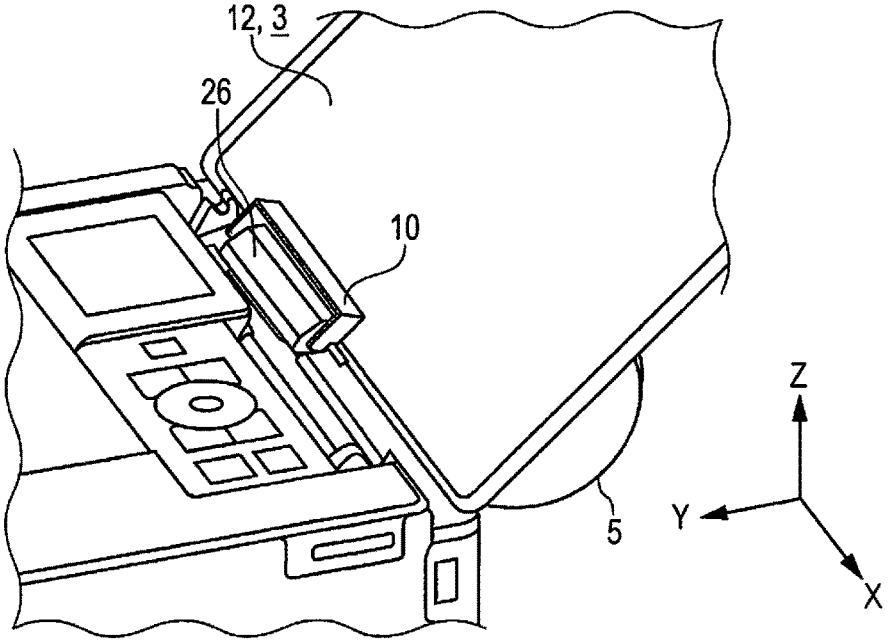
FIG. 6A is a perspective view that shows a state in which a protective member is attached to the recording apparatus that is shown in FIG. 5.
Figure 6B:
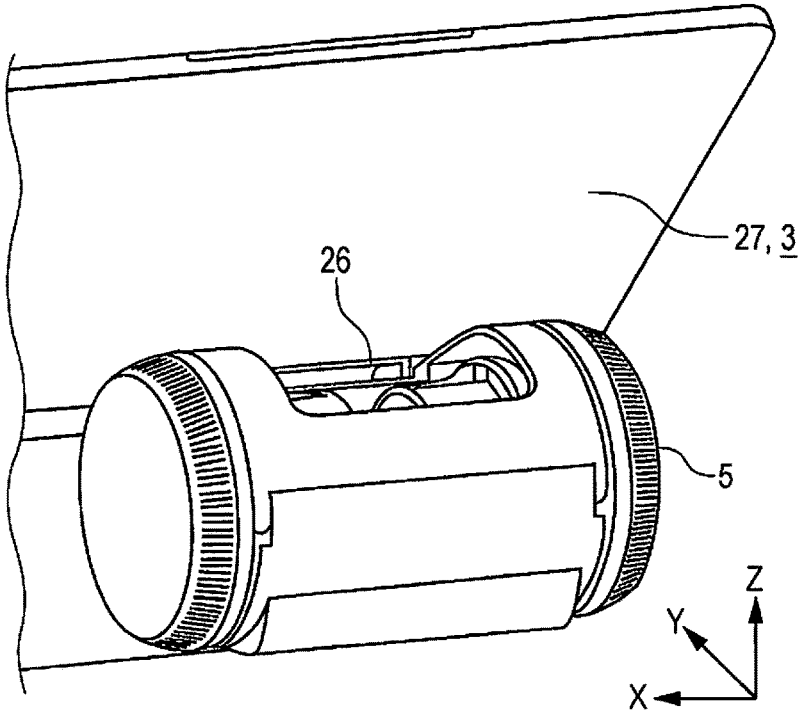
FIG. 6B is a perspective view in which the recording apparatus that is shown in FIG. 6A is viewed from behind.
Figure 7:
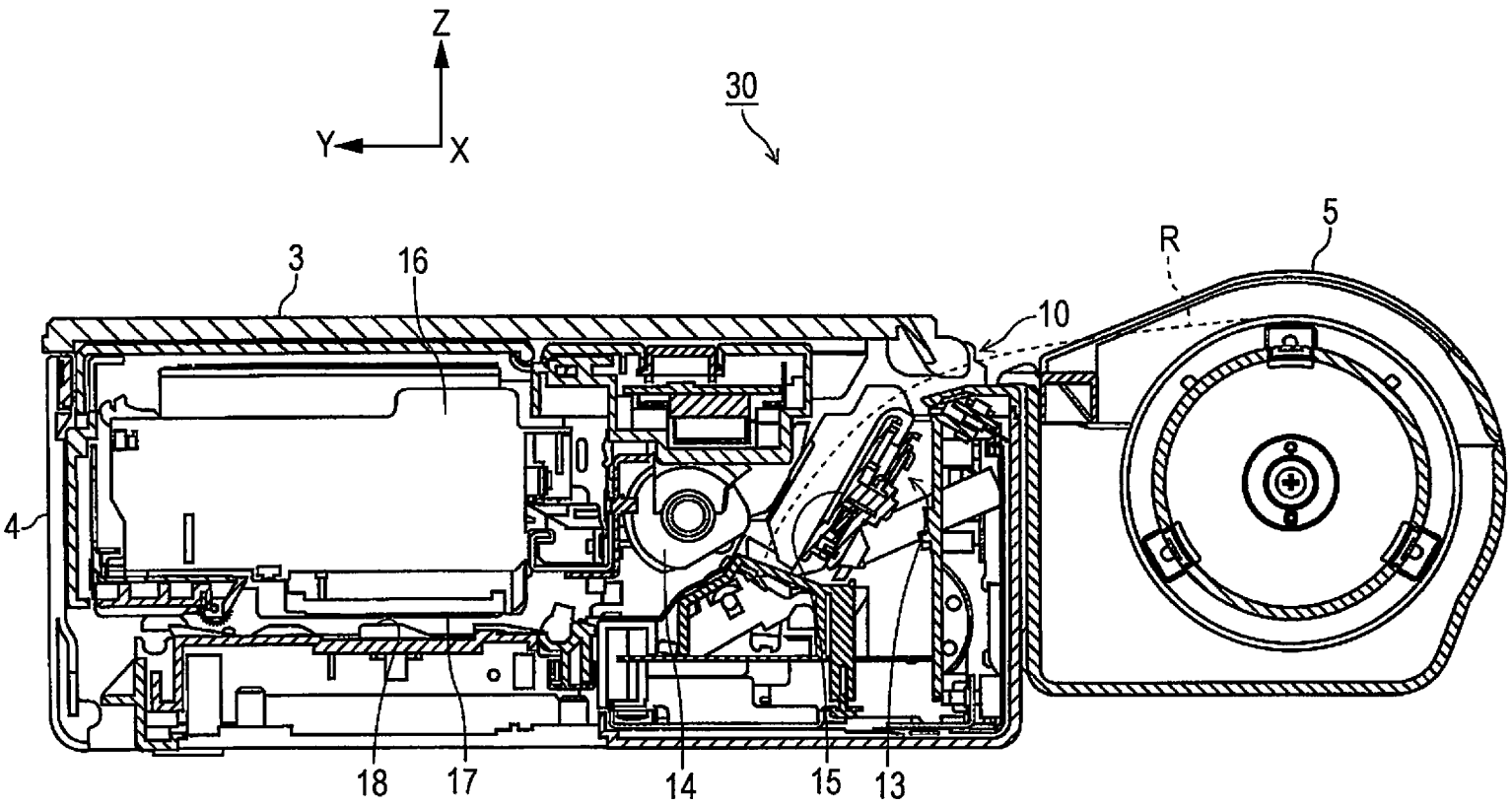
FIG. 7 is a cross-sectional view of a recording apparatus of the related art.

FIG. 1 is a perspective view that represents a recording apparatus 1 according to an embodiment of the invention. FIG. 2 is a perspective view in which the recording apparatus 1 of FIG. 1 is viewed from behind in a state in which an upper surface cover is open. FIG. 3 is cross-sectional view of the recording apparatus that is shown in FIG. 1, and is a view that shows a state in which a first state, in which the hopper is fallen, is assumed. FIG. 4 is an expanded cross-sectional view of the main sections of the recording apparatus that is shown in FIG. 1, and is a view that shows a state in which a second state, in which the hopper is raised, is assumed. FIG. 5 is a perspective view that represents the main sections of the recording apparatus of FIG. 1 in a state in which the upper surface cover is open. FIG. 6A is a perspective view that shows a state in which a protective member is attached to the recording apparatus that is shown in FIG. 5. FIG. 6B is a perspective view in which the recording apparatus that is shown in FIG. 6A is viewed from behind. FIG. 7 is a cross-sectional view of a recording apparatus of the related art.

As shown in FIG. 1, the exterior of the recording apparatus 1 is configured by a main body 2, an upper surface cover 3 that covers an upper surface section 6 (refer to FIG. 2) of the main body 2, and an ejected paper cover 4 that is provided on a side of a front surface (a side surface of a +Y direction side) of the main body 2 in FIG. 1.

Additionally, a −Z direction of a Z axis that is shown in each figure is a direction of gravity, a direction of gravity side is referred to as a lower region (including a lower section, a lower surface and the like), and a side that is opposite thereto is referred to as an upper region (including an upper section, an upper surface and the like).

In the recording apparatus 1, a medium setting section 7 (refer to FIG. 5) into which cut form paper P (refer to FIG. 3), as a medium, is inserted, is provided in the upper surface section 6. In the present embodiment, the upper surface cover 3 is a first opening and closing section that opens and closes the upper surface section 6, which includes the medium setting section 7. In addition, in an open state, the upper surface cover 3 is configured so as to support the cut form paper P that is set on the medium setting section 7 using a support surface 12.

In addition to performing recording on cut form paper P as a medium, the recording apparatus 1 according to embodiment 1 is configured to also perform recording on rolled paper R, and can perform recording on rolled paper R by delivering rolled paper R to the medium setting section 7 from a rolled paper unit 5 that is provided on a back surface side of the main body 2 of the recording apparatus 1, that is, an upstream side (a −Y side) in a medium transport direction of the medium setting section 7.

Rolled paper R that is wound on a roll shaft is stored inside the rolled paper unit 5. One end side of rolled paper R that is sent out from the rolled paper unit 5 is inserted into a rolled paper insertion opening 10, which is provided on an end section side of a downstream side of the upper surface cover 3, from a side of a back surface 27 (refer to FIG. 2) of the support surface 12 of the upper surface cover 3. One end side of the rolled paper R is configured so as to be set on a hopper 13 by being output to a support surface 12 side in a form that passes between the upper surface cover 3 and the main body 2.

Additionally, a transport pathway of rolled paper R will be described in detail later.

Next, a summary of an internal configuration of the recording apparatus 1 will be described using FIG. 3. Additionally, in FIG. 3, a transport pathway of cut form paper P is shown.

In the recording apparatus 1, a configuration in which cut form paper P and rolled paper R, as a medium, are transported toward a +Y direction in FIG. 3, is used. Additionally, hereinafter, there are cases in which a direction in the recording apparatus 1 in which a medium is transported is referred to as "downstream", and a direction that is opposite thereto is referred to as "upstream".

A carriage 16, which is provided with a recording head 17 that performs recording by discharging a liquid onto a medium, is provided inside the main body 2 so as to reciprocate in a direction (an X axis direction) that intersects a transport direction of a medium (the +Y direction). The carriage 16 is equipped with a liquid accommodation body 20 for supplying a liquid (for example, ink) for performing recording on a medium to the recording head 17.

The cut form paper P, as a medium, is set by being inserted from the medium setting section 7, and loaded on a mounting surface 15 of the hopper 13. The hopper 13 is provided to be capable of swinging between a first posture in which the mounting surface 15 is in a fallen state (the state of the hopper 13 in FIG. 3), and a second posture in which the mounting surface 15 is in an uplifted state (the state of the hopper 13 in FIG. 4), and is biased to a side of the second posture by biasing means.

In addition, with respect to the cut form paper P, a plurality of sheets of which are set on the mounting surface 15 of the hopper 13, the topmost sheet of cut form paper P is picked up one unit at a time, and fed downstream in by a paper supply roller 14.

The hopper 13 is configured so as to lift up and swing to a side of the second posture as a number of sheets of cut form paper P on the mounting surface 15 of the hopper 13 becomes smaller, and so that the topmost sheet of cut form paper P always comes into contact with the paper supply roller 14. The hopper 13 is configured so that the hopper 13 and the paper supply roller 14 come into contact in the second posture in which the hopper 13 is in a state of being uplifted most. In FIG. 4, reference numeral 23 is a contact point of the hopper 13 and the paper supply roller 14.

Furthermore, cut form paper P that is sent from the upstream side in the transport direction is transported to a recording position of a lower region (a −Z direction side) of the recording head 17 in a state of being interposed between a pair of rollers for transport (reference numerals not given).

A platen 18, which faces the recording head 17, and which defines a gap between a liquid discharge surface of the recording head 17 and a medium, is provided in a lower region of the recording head 17. Recording is executed between the recording head 17 and the platen 18 by discharging a liquid (ink) onto a medium such as cut form paper P or rolled paper from the recording head 17.

The recording apparatus 1 is configured so that a medium after recording is sent downstream in a transport direction of the recording head 17, ejected from a medium ejection section 19, and mounted on the ejected paper cover 4.

Edge guide sections 11*a* and 11*b*, which guide both side ends in a width direction (the X axis direction in the figure) of a medium P that is set on the medium setting section 7, are provided in the medium setting section 7. In the present embodiment, the edge guide section 11*a* (refer to FIG. 5) is provided to be capable of moving in a sliding manner in the X axis direction as a result of a user manipulating the edge guide section 11*a* with a hand depending on a size of the medium P.

In addition, the edge guide section 11*b* (refer to FIG. 4) of the other end side can be provided so as to move in a sliding manner in synchronization with a first edge guide section 11 using a rack pinion mechanism, for example.

In addition, as shown in FIG. 5, a liquid crystal display 8 that displays various information such as menus and errors, and a manipulation panel 9 on which various kinds of manipulation buttons are disposed, are provided on the upper surface section 6 of the main body 2.

In addition, the upper surface cover 3 that supports the cut form paper P on the support surface 12 in an open state, is configured so that the support surface 12 thereof runs along an inclination of the mounting surface 15 of the hopper 13.

Next, a transport pathway of rolled paper R will be described, and the internal configuration of the recording apparatus 1 will be further described using FIG. 4. Additionally, both a transport pathway of rolled paper R and a transport pathway of cut form paper P are shown in FIG. 4. As described earlier, rolled paper R is stored in the rolled paper unit 5 that is provided on the back surface side (the −Y side) of the main body 2 of the recording apparatus 1, and rolled paper R that is sent out from eh rolled paper unit 5 is inserted into the rolled paper insertion opening 10 from a side of a back surface 27 of the support surface 12 of the upper surface cover 3, and delivered to the mounting surface 15 of the hopper 13 by being output to a support surface 12 side in a form that passes between the upper surface cover 3 and the main body 2.

In the present embodiment, the transport pathway of the rolled paper R and the transport pathway of the cut form paper P are configured so as to converge at a convergence position of reference symbol 25, which is further upstream in the medium transport direction than the hopper 13. The transport pathway of the rolled paper R that is further on an upstream side than the convergence position 25 is referred to as a first pathway W1, and the transport pathway of the cut form paper P that is further on an upstream side than the convergence position 25 is referred to as a second pathway W2. That is, the "first pathway W1" is a medium transport pathway for rolled paper R that delivers rolled paper, and the "second pathway W2" is a medium transport pathway for cut form paper P that delivers cut form paper.

The recording apparatus 1 is provided with a first sensor 21 that detects a medium in the first pathway W1. As shown in FIG. 5, in the present embodiment, the first sensor 21 is provided in a position that is on a main body 2 side, which faces the rolled paper insertion opening 10 that is provided in the upper surface cover 3, and the recording apparatus 1 is configured so that rolled paper R is detected by the first sensor 21 when the rolled paper R passes between the upper surface cover 3 and the main body 2.

As the first sensor 21, it is possible to use an optical sensor that is provided with an optical receiving and emitting unit 22 that irradiates a medium with light, and receives reflected light from the medium. The optical sensor that is provided with the optical receiving and emitting unit 22 can irradiate a surface of rolled paper R, as a medium, with light from the optical receiving and emitting unit 22, and can detect the medium by receiving reflected light from the surface of the medium using the optical receiving and emitting unit 22.

As shown in FIG. 4, it is preferable that an optical axis of the optical receiving and emitting unit 22 is inclined toward a downstream side in the medium transport direction with respect to a vertical direction. As a result of this configuration, it is possible to dispose the optical axis of the optical receiving and emitting unit 22 of the first sensor 21 toward an inner side of the recording apparatus 1. In view of this, it is possible to make it difficult for the recording apparatus 1 to be influenced by light from outside the recording apparatus 1.

In addition, since the rolled paper R that is delivered toward the hopper 13 is inclined toward a slightly lower region, it is possible to provide the optical receiving and emitting unit 22 to incline so as to run along a surface of the rolled paper R.

Furthermore, the recording apparatus 1 is provided with a second sensor 24 that detects that a medium is placed on the mounting surface 15 of the hopper 13. The second sensor 24 detects both media of the rolled paper R and the cut form paper P. As the second sensor 24, it is possible to use an optical sensor with the same configuration as that of the first sensor 21.

In addition, as shown in FIGS. 4, 6A and 6B, a protective member 26 that covers an upper region of the optical receiving and emitting unit 22 is provided in the rolled paper insertion opening 10 in a position that is separated from the optical receiving and emitting unit 22 of the first sensor 21.

According to the protective member 26, it is possible to reduce a concern that light from outside the recording apparatus 1 will enter the optical receiving and emitting unit 22 of the first sensor 21. In addition, since the protective member 26 is provided in a position that is separated from the optical receiving and emitting unit 22 of the first sensor 21, and is configured so that the rolled paper R passes between the protective member 26 and the optical receiving and emitting unit 22 of the first sensor 21, the suppression of curls, which result from a winding tendency of the rolled paper, is made possible by the protective member 26.

Next, an action of the hopper 13 will be described based on the first sensor and the second sensor.

Firstly, a case in which rolled paper R is set in a recording apparatus 30 of the related art will be described using FIG. 7. Additionally, the recording apparatus 30 that is shown in FIG. 7 is not provided with a first sensor in the transport pathway of rolled paper R, but the since the basic configuration according to the transport of rolled paper R is the same as that of the invention, the same reference symbols as those of the recording apparatus 1 will be applied and description will be omitted.

In the recording apparatus 30, in a case in which cut form paper (not shown in the drawings) is not placed on the mounting surface 15 of the hopper 13, the hopper 13 is in a state of having fallen to a position at which it is possible to set a predetermined number of sheets of cut form paper, that is, is in a first posture. Additionally, FIG. 7 shows a state in which the hopper 13 is in the first posture.

In this instance, in a state in which the hopper 13 is in the first posture, since there is a space between the hopper 13 and the paper supply roller 14, if an attempt to set rolled paper R on the hopper 13 is made in this state, there are cases in which the rolled paper becomes rolled up between the hopper 13 and the paper supply roller 14 in accordance with a winding tendency thereof.

If the rolled paper R becomes rolled up, it is difficult for a user to perceive the setting feeling of an end section of the rolled paper abutting against the interior of the hopper 13, and therefore, there is a concern that a user will push more of the rolled paper than is necessary into the recording apparatus 30.

In contrast to this, the recording apparatus 1 according to the present embodiment is configured so that the hopper 13 swings in a direction that assumes the second posture on the basis of detection of a medium by the first sensor 21 and the second sensor 24.

When a medium is detected by the first sensor 21 that is provided in the first pathway W1, which is the medium transport pathway of rolled paper R, it is understood that the setting of rolled paper R is performed. Therefore, by causing the hopper 13 to swing in a direction that assumes the second posture on the basis of detection of at least the first sensor 21, it is possible to reduce a gap between the paper supply roller 14, which is in a position inside the recording apparatus 1 that faces the hopper 13, and the hopper 13 when rolled paper R is set on the hopper 13.

As a result of this configuration, a leading end of the rolled paper R is inserted into a more narrow space, and therefore, a concern that the rolled paper R will become rolled up as a result of a winding tendency, is reduced, and it is easier to understand a feeling of a leading end of the rolled paper R abutting against the interior of the hopper 13, that is, a setting feeling of the rolled paper R on the hopper 13.

In view of this, the reliability of the setting feeling of the rolled paper R by a user is increased, and therefore, a concern that a user will push more of the rolled paper R than is necessary into the recording apparatus, is reduced, and it is possible to reliably set the rolled paper R.

Additionally, it is preferable that the hopper 13, which swings, is set to an uplifted state until the second posture is assumed, that is, until the paper supply roller 14 and the hopper 13 come into contact.

As a result of this configuration, since rolled paper R abuts against an opening that is formed by the paper supply roller 14 and the hopper 13 coming into contact at the contact point 23, the perception of the setting feeling of the rolled paper R is made easier. In view of this, the reliability of the setting feeling of the rolled paper R by a user is improved.

In addition, it is possible to configure a timing with which the hopper 13 swings from the first posture in a direction that assumes the second posture, so that the hopper 13 swings using the fact that the second sensor 24 has detected a medium (the rolled paper R) after the detection of a the rolled paper R by the first sensor 21. In the rolled paper R, since there are cases in which a leading end thereof curls as a result of a winding tendency, there are cases in which insertion into a narrow space is difficult.

When the rolled paper R is initially inserted onto the hopper 13, since the hopper 13 is in the fallen first posture, the insertion thereof is made easier by swinging the hopper 13 in a manner in which the hopper 13 is lifted up to a side of the second posture when the second sensor 24 detects a medium. Further, when the rolled paper R abuts against the interior of the hopper 13, it is possible to reduce a gap between the hopper 13 and the paper supply roller 14 by lifting the hopper 13 up to the side of the second posture after the rolled paper R has passed through a predetermined position (for example, a position that faces the second sensor 24 that is shown in FIG. 4) of the mounting surface 15 of the hopper 13.

In addition, there are cases in which a user begins to use rolled paper R in a case in which cut form paper P is still placed on the hopper 13. In a case in which the second sensor 24 has already detected a medium when rolled paper R is detected by the first sensor 21, it is possible to determine that it is a state in which cut form paper P is placed on the hopper 13. At this time, it is preferable to notify a user that there is cut form paper P on the hopper 13 using an alarm sound or a UI.

In addition, in the present embodiment, since the first pathway W1 and the second pathway W2 converge further upstream in a medium transport direction than the hopper 13, it is possible to reliably detect fed rolled paper R before the rolled paper R is delivered to the hopper 13.

Furthermore, it is possible to reliably detect whether rolled paper R is delivered to the hopper 13 or whether cut form paper P is delivered as a result of the second sensor 24 being used for both the cut form paper P and the rolled paper R, and detecting the rolled paper R using the first sensor 21 before the rolled paper R is delivered to the hopper 13.

Additionally, in the present embodiment, a recording apparatus 1 that is provided with the first sensor 21 and the second sensor 24 is described, but in a recording apparatus that is provided with the first sensor 21 only, a configuration in which the hopper 13 swings to a second posture side on the basis of the rolled paper R being detected by the first sensor 21, may also be used. In such an instance, the hopper 13 may be swung immediately after detecting the rolled paper R with the first sensor 21, but for example, it is possible to swing the hopper 13 by setting a predetermined timing (for example, a few seconds) after the rolled paper R is detected by the first sensor 21.

In addition, in the recording apparatus 1, the rolled paper R is configured so as to pass between the rolled paper insertion opening 10, which is formed by notching an end section of a downstream side of the upper surface cover 3, and the main body 2, but for example, it is possible to form the rolled paper insertion opening 10 as an aperture in a surface that is in a position that is close to an end section of a downstream side of the upper surface cover 3.

In addition, it is possible to configure such that a gap is opened to the extent that it is possible for the rolled paper R to pass through, between the upper surface cover 3 and the main body 2 when the upper surface cover 3 is in an open state, and use the gap as the rolled paper insertion opening 10.

Additionally, the invention is not limited to the above-mentioned embodiment, various modifications are possible within the scope of the invention that is disclosed in the aspects of the invention, and such modifications are also included within the scope of the invention.

The entire disclosure of Japanese Patent Application No. 2014-079865, filed Apr. 9, 2014 is expressly incorporated by reference herein.

What is claimed is:

1. A recording apparatus comprising:

a hopper which is provided with a mounting surface on which a medium is set, and which is provided to be capable of swinging between a first posture in which the mounting surface of the medium is in a fallen state, and a second posture in which the mounting surface is in an uplifted state;

a first pathway that delivers rolled paper, as the medium, to the hopper from an upstream side thereof;

a second pathway that delivers cut form paper, as the medium, to the hopper from an upstream side thereof;

a first sensor that detects the medium in the first pathway; and a second sensor that detects that the medium is mounted on the mounting surface of the hopper, wherein the hopper swings from the first posture in a direction that assumes the second posture on the basis of detection of the medium by the first sensor and the second sensor.

2. The recording apparatus according to claim 1, further comprising:

a feeding roller that feeds the medium, wherein the hopper is configured so as to come into contact with the feeding roller in the second posture, and wherein the second posture is assumed when the hopper swings on the basis of the detection of the medium by the sensors.

3. The recording apparatus according to claim 2, wherein the first pathway and the second pathway converge further upstream in a medium transport direction than a portion at which the hopper and the feeding roller come into contact.

4. The recording apparatus according to claim 3, further comprising:

a first opening and closing section, which opens and closes an upper surface section of a main body of the recording apparatus, supports the cut form paper that is set on the hopper in an open state, and forms at least a portion of the second pathway, wherein the first pathway is configured so as to pass between a downstream side end section of the first opening and closing section and the main body from a back surface side of a support surface of the first opening and closing section, and converge with the second pathway on a side of the support surface.

5. The recording apparatus according to claim 4, wherein the first sensor is an optical sensor that is provided with an optical receiving and emitting unit that irradiates the medium with light, and receives reflected light from the medium, and wherein an optical axis of the optical receiving and emitting unit is inclined toward a downstream side in the medium transport direction with respect to a vertical direction.

6. The recording apparatus according to claim 5, further comprising:

a protective member that covers an upper region of the optical receiving and emitting unit of the first sensor in a position that is separated from the optical receiving and emitting unit of the first sensor.

* * * * *